United States Patent [19]

Robinson et al.

[11] Patent Number: 4,507,888

[45] Date of Patent: Apr. 2, 1985

[54] MAGNETIC DIGITAL DISPLAY SIGN

[75] Inventors: Larry G. Robinson, Springfield; Edward C. King, Eugene, both of Oreg.

[73] Assignee: King Design, Inc., Eugene, Oreg.

[21] Appl. No.: 493,970

[22] Filed: May 12, 1983

[51] Int. Cl.[3] ..... G09F 7/04

[52] U.S. Cl. ..... 40/621; 40/447; 40/449; 40/450; 40/600

[58] Field of Search ..... 40/447, 450, 451, 449, 40/452, 576, 594, 595, 600, 621

[56] References Cited

U.S. PATENT DOCUMENTS

| | | | |
|---|---|---|---|
| 3,782,016 | 1/1974 | Ashton et al. | 40/451 |
| 3,988,845 | 11/1976 | Boatman | 40/595 |
| 4,242,823 | 1/1981 | Bruno | 40/621 |

*Primary Examiner*—John J. Wilson
*Assistant Examiner*—Cary E. Stone
*Attorney, Agent, or Firm*—Klarquist, Sparkman, Campbell, Leigh & Whinston

[57] ABSTRACT

A sign for displaying information including numerals, having a background member including ferromagnetic material and a plurality of substantially similar individual character elements which may be magnetically attached to the background member to cooperatively form individual digits. Seven or fewer individual character elements, each preferably having the identical elongated hexagonal shape, are combined to form each digit of a price being advertised. Each such character element is made of flexible sheet material including comminuted permanently magnetized material, and an outer surface of each character element may be coated with light-reflective or fluorescent paint of a color contrasting with the color of the background member. Alternative labels may be magnetically mounted on the background member to identify the product for which the price is advertised.

15 Claims, 9 Drawing Figures

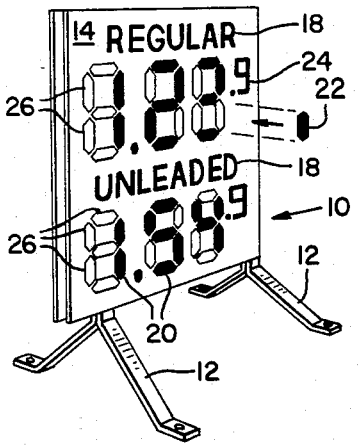
FIG. 1
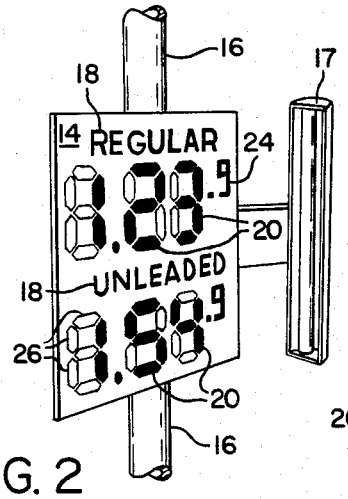
FIG. 2
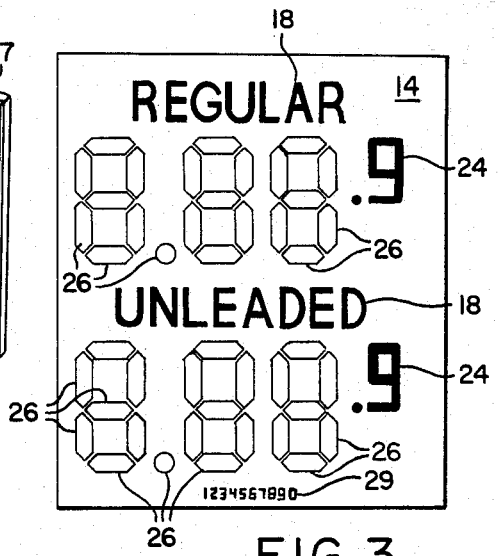
FIG. 3
FIG. 4
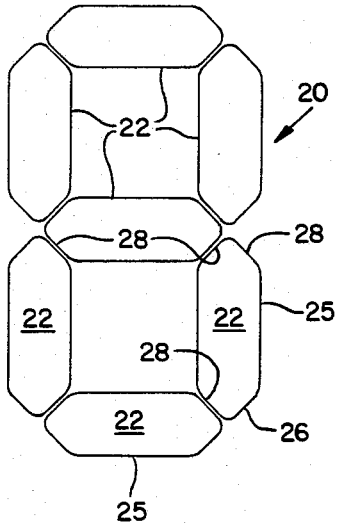
FIG. 8
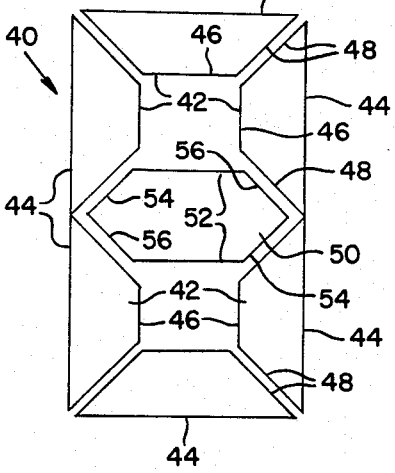
FIG. 9
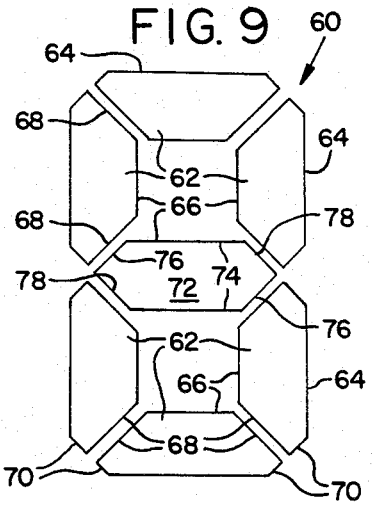
FIG. 5
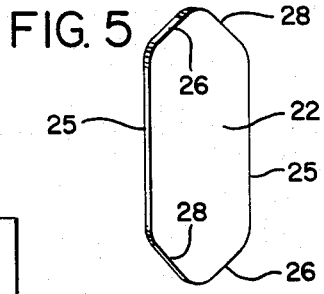
FIG. 6
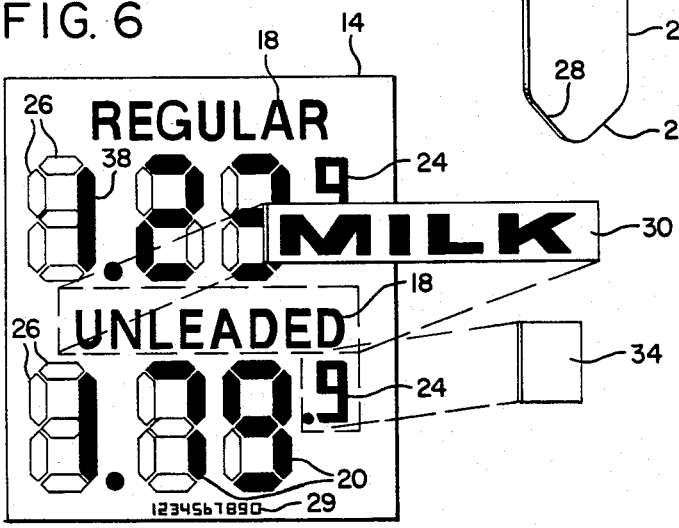
FIG. 7
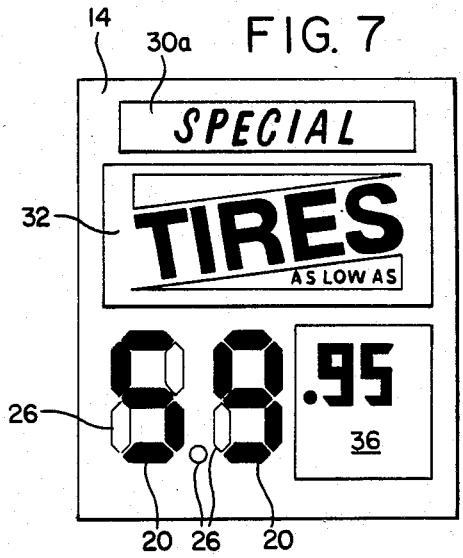

MAGNETIC DIGITAL DISPLAY SIGN

TECHNICAL FIELD

The present invention is related to signs, and particularly to signs for displaying numerals, such as prices, which are frequently changed.

BACKGROUND OF THE INVENTION

Signs are frequently used to display prominently the prices being currently charged for products, especially for gasoline, diesel fuel, and the like at service stations, as well as for fresh fruit and vegetables, milk, and other staple food products often sold at roadside stands. Such signs use figures of a large enough size to be easily read at a distance by motorists, thus to attract them to stop and make purchases. Previously, such signs have frequently utilized separate figures, made, for example, of solid black plastic sheet material cut to the shape of individual digits, with each digit being mounted against a white background which may be internally illuminated to make the sign readable at night. Changes in the prices displayed by such signs require removal of one digit and its replacement by another different digit. Therefore, for prices up to and including nine dollars, ninety nine cents ($9.99), twenty-nine separate numeral characters are required in order to be able to display each possible price, and as many separate characters are required to be available for each price which is to be displayed. Such numeral characters, usually made of rigid plastic sheet material, are breakable and subject to being broken, either by being blown off the sign and breaking upon impact with the ground, or as a result of being dropped while numbers are being changed. Once broken, a numeral must be replaced. As a result, spare numerals must be kept on hand, at greater expense and requiring more storage space.

In the case of large signs, where individual numeral characters are a meter or more in height, it is difficult to handle the individual numeral characters, particularly in windy conditions, and it is therefore difficult to revise the displayed prices for goods using such numerals.

Electrically controlled multi-element illuminated signs have become available in recent years, and are convenient to use. Such signs, however, are very expensive, to build, operate and maintain. Except for locations atop tall poles along major highways, where prices must be seen at a great distance in order to attract motorists to leave the highway, such signs are too expensive to be practical. Accordingly, what is needed is an easily revised price display sign which is attractive in appearance, is much less costly than such electrically controllable illuminated signs, and which does not require the maintenance and storage of a large number of numeral characters which take up a relatively large amount of space while they are not in use.

SUMMARY OF THE INVENTION

The present invention provides an inexpensive sign including easily changed numerals for use in advertising the prices of products, with the prices being displayed in a modern, attractive format. In a price display sign according to the present invention a substantially planar background member is of a first color and includes a quantity of ferromagnetic material, which may be in the form of a sheet of magnetic steel carried on a suitable frame supported by a stand or on brackets for attaching the frame to a supporting pole. Labels giving the names of the most frequently advertised goods, such as "REGULAR" or "UNLEADED", in the case of gasoline, may be painted on the background member in a contrasting color.

The digits of the advertised price are displayed in a form similar to that commonly used in electronic clocks and watches having digital displays, in which each digit is represented by the proper combination of up to seven (7) bar-like character elements. Each character element in the sign embodying the present invention is an elongated piece of material, preferably flexible sheet plastic or synthetic rubber material in which a quantity of comminuted permanently magnetic material is distributed in an amount sufficient to magnetically retain the character element attached to the background member. Such material is readily available and is well known in the advertising industry, molded and painted in appropriate colors for use as magnetic signs which may be applied to "company cars." Each magnetically adherent character element for the numerals of the sign embodying the present invention may be painted in a color contrasting with the color of the background member, and may also preferably have a reflective or fluorescent coating to make the numerals more prominently visible against the background, particularly during darkness or periods of poor light conditions.

Preferably, indicia are provided on the background member to guide the user of the sign in placement of the individual character elements for formation of numerals having the best possible appearance.

An illustrative display of each of the numerals from zero (0) through nine (9) as formed by combining the character elements according to the present invention is provided at an unobtrusive location on the sign, for example, along the bottom edge of the background member. Preferably, both the character element placement guide indicia and the illustrative numeral display are of a color or surface texture which contrasts only slightly with that of the background member, so that they are clearly visible to one who is revising the numerals displayed on the sign, yet do not unduly attract the attention or cause confusion of a person viewing the sign from any substantially greater distance.

For added flexibility and convenience in use of the sign of the invention, alternative label sheets including commonly used product names may be provided to temporarily cover the permanently applied labels on the sign. For instance, such labels as "SPECIAL," "DIESEL," and "MILK," may be provided as flexible magnetically retained label signs, or an even larger magnetically retained sign may be used to display the name or a drawing of another product in place of a price display ordinarily shown on the sign.

The style of numerals displayed in the sign of the present invention is now completely familiar to the ordinary buying public, which has become accustomed to the digital displays used in electronic clocks and the like, and the modern appearance provided by the present magnetic digital display sign is an attractive feature not previously available in such price display signs.

It is therefore a principle objective of the present invention to provide a price display sign whose initial cost and cost of maintenance are lower than for previously used price display signs.

It is another important objective of the present invention to provide a price display sign in which changing displayed prices is more convenient than with previously available price display signs.

It is yet a further objective of the present invention to provide a price display sign in which it is convenient to change the identification of the product being advertised.

It is an important feature of the present invention that it includes a set of identical character elements which adhere magnetically to a background member in various arrangements to form each of the digits from zero through nine.

It is another feature of the present invention that it includes interchangable labels to identify products whose price is being advertised.

It is a principal advantage of the present invention that it provides a price display sign which is less expensive than previously known price display signs having interchangeable numerals.

It is another important advantage that the character elements of the present invention are less susceptible to damage than the complete numerals of previously available signs.

It is yet a further advantage of the present invention that, particularly in large signs, it makes alteration of numerals indicating prices easier than in previously known price display signs of the same size.

The foregoing and other objectives, features, and advantages of the invention will be more readily understood upon consideration of the following detailed description of the invention, taken in conjunction with the accompanying drawings.

BRIEF DESCRIPTION OF THE DRAWINGS

FIG. 1 is a perspective view of a self-supported sign embodying the present invention, including changeable numerals for advertising the price of gasoline.

FIG. 2 is a perspective view of another gasoline price sign embodying the present invention, showing the sign mounted on a pole.

FIG. 3 is a front elevational view of the face of the sign shown in FIG. 1.

FIG. 4 is a diagrammatic view showing the arrangement of the character elements to form a single digit of the changeable numerals of the sign shown in FIG. 1, at an enlarged scale.

FIG. 5 is a perspective view of one of the magnetically adherent character elements intended for use with the sign shown in FIG. 1, at an enlarged scale.

FIG. 6 is a front elevational exploded view of the display portion of the sign shown in FIG. 1, showing the manner of use of an alternative label.

FIG. 7 is a front elevational view of the display portion of a sign similar to that shown in FIG. 1, showing its use to more prominently display the price of a single advertised item.

FIG. 8 is a diagrammatic view showing the arrangement of character elements of an alternative shape to form a single digit for a sign embodying the present invention.

FIG. 9 is a diagrammatic view showing the arrangement of character elements of yet another alternative shape to form a single digit for a sign embodying the present invention.

DETAILED DESCRIPTION OF THE INVENTION

Referring now to the drawings, in FIG. 1 a sign 10 embodying the present invention includes a pair of supports 12 supporting a generally planar background member 14 which may, for example, be a sheet of mild steel or other ferromagnetic material of suitable thickness, supported if necessary by a frame of angle stock. The total weight of the sign 10, including the supports 12 and the background member 14 is thus sufficient to resist being blown over by wind. Alternatively, as shown in FIG. 2, the background member 14 may be attached to a fixed pole 16, using suitable brackets (not shown), if such a pole is readily available where it is desired to display the sign. Additionally, a lamp 17 may be mounted on the pole 16 to illuminate the sign 10.

As may be seen in greater detail in FIG. 3, the sign 10 includes, for example, labels 18 which may be stenciled on the background member 14 in a color contrasting attractively and visibly with the color of the background member 14, as a permanent indication of the product whose price is being advertised. The price of the product, being frequently changeable in response to market conditions of supply and demand, is indicated by the use of changeable numeral digits 20 located on the background member 14, each digit 20 being formed by the use of a plurality of character elements 22, which, in a preferred embodiment of the invention, are all identical to one another. For convenience, a portion 24 of such a price, such as the "0.9," which is rarely changed, may be permanently applied to the background member 14, as are the product labels 18.

Each of the character elements 22 is removably attached to the background member 14, preferably magnetically. Each character element 22 is made of flexible sheet material such as a plastic or synthetic rubber approximately 2 mm thick, for example, and containing dispersed, comminuted, permanently magnetized material such as iron, iron oxide, or a nickel alloy. Such flexible magnetized material is well known in magnetic signs commonly attached removably to the doors of motor vehicles as business advertisements. The amount of the permanently magnetic material dispersed within such flexible material is sufficient to cause the material to cling to a ferromagnetic sheet with adequate force to avoid being dislodged by wind.

Preferably, each of the character elements 22 used in combination to form numeral digits 20 according to the present invention is of a single size and shape as shown in FIGS. 4 and 5. A preferable shape is an elongated hexagon having a first pair of parallel sides 25 of equal length, and second and third pairs of opposite shorter sides 28, respectively, all being of substantially equal length. The shorter sides 26 and 28 intersect with one another at each end of the hexagonal character element 22 at an angle of approximately 90 degrees. For the sake of improved appearance, the sides 24, 26 and 28 do not intersect in sharp angular corners, but each angle is rounded off somewhat, and each side 25 is at least as long as the distance between the pair of sides 25.

As shown in FIGS. 1–4, seven of the character elements 22 may be combined to form the figure "8", and fewer than seven of the character elements may be used to form each of the other digits from "0" to "9." The particular shape of each character element 22 lends itself to such an arrangement and adds greatly to the convenience of the present sign as compared with the previously known price display signs in which a separate complete numeral element is required to display each different digit. At least two of the character elements 22 are required for each numeral digit 20 displayed, and the remaining unused character elements 22, being smaller and more flexible, may be stored much more conveniently than the large complete numerals needed previously.

The appropriate location for placement of each character element 22, and for a similarly removable decimal point, is indicated on the background member 14 by the use, for example, of an outline 26 stenciled on the background member 14 in a color or texture which contrasts sufficiently with color and texture of the background member 14 to be visible to one who is revising the digits 20, but which is not so prominent as to be confusing to a potential customer viewing the sign from a distance of several feet or more. The purpose of such outlines 26 of the character elements is simply to assure that the character elements 22 are quickly and easily placed on the background member 14 in the proper locations to form the desired individual digits 20 and provide a neat, attractive appearance.

As a guide to a person installing the character elements 22, an exemplary set 29 of small numerals "0" through "9" may also be stenciled or otherwise permanently applied on the background member 14 in a form illustrating proper placement of the actual character elements 22 to form each of the digits. Such an exemplary display of each digit may be provided along a lower margin of the background element 14, or in any other convenient location where it will not be distractingly apparent to potential customers. As each digit is formed of a number of identical character elements 22, revision of a price can be accomplished much more quickly than if each replacement numeral has to be separately located and installed.

Since it may at times be desirable to display prominently the prices of products other than those whose prices are normally displayed, an alternative label for use in displaying the name of such an alternative product may be provided. For example, an alternative label 30 is made of the same type of flexible material including comminuted permanently magnetized material as is used for the character elements 22. The alternative label 30, with an appropriate product name shown thereon, as illustrated in FIG. 6 for the alternative label "MILK," may be used to obscure the permanently applied product label "REGULAR."

Similarly, a magnetic sign may be used as illustrated in FIG. 7 to display the name of a specially promoted product even more prominently, by locating an alternative label 30*a* and a larger magnetically adherent alternative display sheet 32 to cover the normal location of a "REGULAR" label and price display and the permanent label "UNLEADED." Additional magnetic sheets 34 and 36 may similarly be used to obscure unnecessary items such as the permanent portion 24 of a price (FIG. 6), or the final changeable digit 20 of a price, as in FIG. 7.

As may also be seen in FIG. 6, a double-length character element 38 may be used for the digit "1," as an option.

Referring now also to FIG. 8, an arrangement for a changeable numeral digit 40 embodying the present invention is seen to include character elements 42 which are trapezoidal in shape, each including a long outer side 44, a shorter inner side 46 which is parallel with the outer side 44, and ends 48 which extend between the outer side 44 and the inner side 46, preferably oriented at approximately a 45-degree angle with the outer sides 44. The numeral digit shown in FIG. 8 uses two, three, four, five, or six of the trapezoidal character elements 42. It may also use a center bar element 50 which is hexagonal in shape, and which includes a pair of parallel longer sides 52 and two pairs of opposite parallel shorter sides 54 and 56 which intersect in approximately 90-degree angles at the respective ends of the center bar element 50.

Yet another alternative form 60 of the changeable digits for use in the present invention includes hexagonal character elements 62, each having a long outer side 64, a shorter inner side 66, a pair of miter sides 68, and a pair of beveled ends 70. Preferably the miter sides 68 intersect the inner sides 64 at an angle of approximately 135 degrees, and the bevelled ends 70 are approximately perpendicular to the miter sides 68. A center bar 72 is similar to the center bar 50, having a pair of longer sides 74 and two pairs of opposite shorter sides 76 and 78 which intersect one another at an angle of approximately 90 degrees.

To improve visibility of the prices advertised by use of the sign 10, the character elements 22, or in the other embodiments 40 and 60 of digits according to the present invention, the character elements 42 and 62 and the center bar elements 50 and 72, are preferably coated with reflective fluorescent paint, and a lamp 17 may be of a type which produces light which will cause such a coating to fluoresce and appear more prominently than it would in ordinary white light.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A sign for displaying information including numerals, comprising:

a background member of a first color;

a plurality of character elements having an appearance contrasting with that of the background member;

the background material and the character elements including magnetic means for attaching removably each character element to said background member in a location relative to at least one other of said plurality of character elements so as to form selectively any desired digit;

a permanently applied label on said background member; and at least one alternative label including magnetic retention means for removably attaching said alternative label to said background member so as to obscure said permanently applied label.

2. The sign of claim 1, wherein said background member comprises a sheet of said ferromagnetic material covered by material of said first color.

3. The sign of claim 1, including indicia means located on said background member for guiding placement of said character elements for forming said desired digit.

4. The sign of claim 3, wherein said indicia means comprises an outline for indicating a location for placement of each character element, each said outline having an appearance which contrasts poorly with said first color, but which is visible to a person within arm's length of said sign.

5. The sign of claim 1, the alternative label comprising a magnetically adherent label member for use as an identification of goods for which a price is indicated in digits formed by combination of said character elements.

6. The sign of claim 1, wherein each of said plurality of character elements is of a single size and shape.

7. The sign of claim 6, including a plurality of illustrative numerals displayed on said background member in a substantially smaller size than the digits of a displayed price, so as to show proper arrangement of said character elements to form each of the arabic numeral digits.

8. The sign of claim 6, wherein each character element is generally hexagonal, having first, second, and third pairs of opposite, substantially parallel sides, the sides of each pair being of substantially equal length, and the ones of said first pair being substantially longer than the ones of each of the other two pairs.

9. The sign of claim 8, wherein said second and third pairs of sides are of substantially equal length and each side of said second pair is approximately perpendicular to each side of said third pair.

10. The sign of claim 9, wherein said sides of said first pair are at least as long as the distance separating them from one another.

11. The sign of claim 1, further including a unitary character element for the numeral "1" which is substantially twice as long as each of the character elements of said plurality of character elements.

12. The sign of claim 1, wherein said plurality of character elements comprises a set of substantially similar character elements each having a substantially trapezoidal shape including an outer side, a shorter inner side substantially parallel with said outer side, and a pair of opposite ends interconnecting said outer and inner sides.

13. The sign of claim 1, wherein each one of said plurality of character elements is of a flexible material containing a sufficient amount of comminuted permanently magnetic material to make each said character element magnetically adhere to said background member.

14. The sign of claim 1, wherein said background member is of a light-absorbing color and each said character element includes a reflective coating.

15. The sign of claim 1, wherein at least a normally exposed surface of each of said character elements is covered with a fluorescent coating.

* * * * *